US007819331B2

(12) United States Patent
Arneson

(10) Patent No.: US 7,819,331 B2
(45) Date of Patent: Oct. 26, 2010

(54) HVAC STAGING CONTROL

(75) Inventor: David J. Arneson, Ham Lake, MN (US)

(73) Assignee: Honeywell International Inc., Morristown, NJ (US)

( * ) Notice: Subject to any disclaimer, the term of this patent is extended or adjusted under 35 U.S.C. 154(b) by 761 days.

(21) Appl. No.: 11/735,245

(22) Filed: Apr. 13, 2007

(65) Prior Publication Data

US 2008/0251590 A1 Oct. 16, 2008

(51) Int. Cl.
*F24D 19/10* (2006.01)
*F24F 11/00* (2006.01)
*G05D 23/275* (2006.01)

(52) U.S. Cl. ..... 236/1 B; 62/157; 62/158; 236/46 C; 165/205; 165/212

(58) Field of Classification Search ..... 62/157, 62/158, 228.5; 165/205, 208, 212; 236/1 B, 236/16, 46 C; 700/277
See application file for complete search history.

(56) References Cited

U.S. PATENT DOCUMENTS

| | | | |
|---|---|---|---|
| 3,664,414 | A | 5/1972 | Raleigh |
| 3,892,104 | A | 7/1975 | Klee et al. |
| 4,071,745 | A | 1/1978 | Hall |
| 4,205,381 | A | 5/1980 | Games et al. |
| 4,335,320 | A | 6/1982 | Garver |
| 4,338,791 | A | 7/1982 | Stamp, Jr. et al. |
| 4,495,986 | A | 1/1985 | Clark et al. |
| 4,501,125 | A | 2/1985 | Han |
| 4,530,395 | A | 7/1985 | Parker et al. |

(Continued)

FOREIGN PATENT DOCUMENTS

| | | |
|---|---|---|
| SK | 20556 | 10/2001 |

OTHER PUBLICATIONS

"EWC Controls Inc-Technical Bulletin Model UZC4 Zone Control", (Dec. 12, 2005),24 pages.

(Continued)

*Primary Examiner*—Cheryl J Tyler
*Assistant Examiner*—Paolo Gonzalez
(74) *Attorney, Agent, or Firm*—Crompton Seager & Tufte LLC

(57) ABSTRACT

A controller for an HVAC system having a plurality of zones and having a multiple stage fluid temperature conditioning device. The controller is configured to receive a plurality of thermostat signals and to transmit a signal to control one of a plurality of flow control devices in response to a call for conditioning in one of the plurality of zones. The controller also includes one or more timers that are connected to the thermostat terminals, where the one or more timers are configured to initiate a separate timing count upon each call for conditioning in any one of the plurality of zones. In addition, the controller includes one or more staging terminals for transmitting staging signals to control a multiple stage fluid temperature conditioning device, where the transmission of the staging signals determines whether the conditioning device will operate at a relatively higher output stage. The controller is also configured to make a timing count determination to determine if any one of the separate timing counts initiated upon each call for conditioning in any one of the plurality of zones exceeds a timing delay parameter. The transmission of staging signals depends on the timing count determination. A method is also disclosed.

17 Claims, 6 Drawing Sheets

U.S. PATENT DOCUMENTS

| | | | |
|---|---|---|---|
| 4,795,088 | A | 1/1989 | Kobayashi et al. |
| 4,830,095 | A | 5/1989 | Friend |
| 4,843,084 | A | 6/1989 | Parker et al. |
| 4,932,466 | A | 6/1990 | Foster |
| 5,024,265 | A | 6/1991 | Buchholz et al. |
| D319,429 | S | 8/1991 | D'Aleo et al. |
| 5,042,265 | A | 8/1991 | Baldwin et al. |
| 5,092,394 | A | 3/1992 | Foster |
| 5,129,234 | A | 7/1992 | Alford |
| D329,226 | S | 9/1992 | Holbrook |
| 5,161,608 | A | 11/1992 | Osheroff |
| 5,245,835 | A | 9/1993 | Cohen et al. |
| 5,303,767 | A | 4/1994 | Riley |
| 5,318,104 | A | 6/1994 | Shah et al. |
| 5,344,069 | A | 9/1994 | Narikiyo |
| 5,348,078 | A | 9/1994 | Dushane et al. |
| 5,449,319 | A | 9/1995 | Dushane et al. |
| 5,495,887 | A | 3/1996 | Kathnelson et al. |
| 5,751,572 | A | 5/1998 | Maciulewicz |
| 5,818,194 | A | 10/1998 | Nordby |
| 5,829,674 | A | 11/1998 | Vanostrand et al. |
| 5,860,473 | A | 1/1999 | Seiden |
| 5,944,098 | A | 8/1999 | Jackson |
| 5,983,890 | A | 11/1999 | Thomas et al. |
| 6,196,467 | B1 | 3/2001 | Dushane et al. |
| D449,279 | S | 10/2001 | Takach, Jr. et al. |
| D454,544 | S | 3/2002 | Takach, Jr. et al. |
| 6,354,093 | B2 * | 3/2002 | Davis et al. ..... 62/89 |
| 6,402,043 | B1 | 6/2002 | Cockerill |
| 6,540,148 | B1 * | 4/2003 | Salsbury et al. ..... 236/1 EA |
| 6,574,581 | B1 | 6/2003 | Bohrer et al. |
| 6,705,533 | B2 | 3/2004 | Casey et al. |
| 6,711,471 | B2 | 3/2004 | Kidder |
| 6,725,914 | B2 | 4/2004 | Petterson |
| 6,851,621 | B1 | 2/2005 | Wacker et al. |
| 6,856,841 | B2 | 2/2005 | Peterson |
| 6,874,693 | B2 | 4/2005 | Readio et al. |
| 6,879,881 | B1 | 4/2005 | Attridge, Jr. |
| 6,957,696 | B1 * | 10/2005 | Krumnow ..... 165/208 |
| 6,964,174 | B2 | 11/2005 | Shah |
| 6,967,565 | B2 | 11/2005 | Lingemann |
| 6,986,708 | B2 | 1/2006 | Demster |
| 6,997,390 | B2 | 2/2006 | Alles |
| 7,000,849 | B2 | 2/2006 | Ashworth et al. |
| 7,017,827 | B2 | 3/2006 | Shah et al. |
| 7,047,092 | B2 | 5/2006 | Wimsatt |
| 7,055,759 | B2 | 6/2006 | Wacker et al. |
| 7,106,019 | B2 | 9/2006 | Becerra et al. |
| 7,114,554 | B2 | 10/2006 | Bergman et al. |
| 7,130,719 | B2 | 10/2006 | Ehlers et al. |
| 7,150,408 | B2 | 12/2006 | DeLuca |
| 7,156,316 | B2 | 1/2007 | Kates |
| 7,188,002 | B2 | 3/2007 | Chapman, Jr. et al. |
| 7,228,693 | B2 | 6/2007 | Helt |
| 7,320,362 | B2 | 1/2008 | Nichols |
| 7,360,370 | B2 | 4/2008 | Shah et al. |
| D590,352 | S | 4/2009 | Jacoby et al. |
| 2003/0103075 | A1 | 6/2003 | Rosselot |
| 2004/0194484 | A1 | 10/2004 | Zou et al. |
| 2004/0262410 | A1 | 12/2004 | Hull |
| 2005/0040248 | A1 | 2/2005 | Wacker et al. |
| 2005/0043907 | A1 | 2/2005 | Eckel et al. |
| 2005/0156049 | A1 | 7/2005 | Van Ostrand et al. |
| 2005/0159847 | A1 | 7/2005 | Shah et al. |
| 2005/0159924 | A1 | 7/2005 | Shah et al. |
| 2005/0228607 | A1 | 10/2005 | Simons |
| 2005/0288824 | A1 | 12/2005 | Fisher |
| 2006/0004492 | A1 | 1/2006 | Terlson et al. |
| 2007/0045429 | A1 | 3/2007 | Chapman et al. |
| 2007/0050732 | A1 | 3/2007 | Chapman et al. |
| 2007/0057075 | A1 | 3/2007 | Votaw et al. |
| 2007/0225868 | A1 | 9/2007 | Terlson et al. |

OTHER PUBLICATIONS

"HVAC Talk", www.HVAC-talk.com, (Nov. 17, 2006), 2 pages.

"Jackson Systems-Residential and Light Commercial Zone Control (Z-600) Two Position", www.jacksonsystems.com, (At least as early as Feb. 8, 2007) 2 pages.

"Newest Product-UZC4", www.ewccontrols.com, (Oct. 20, 2005), 3 pages.

"Zonefirst-Masterzone Heat Pump Zoning System-Model MMH3", (Copyright 2003), 2 pages.

Drew, Jerry C., "XCI-Proper Staging Techniques for Multi-Stage Thermostats", *Home Toys Article*—www.hometoys.com, (Dec. 2002), 4 pages.

"DIGI3U", Zonex Systems 3-Zone Universal Controller for G/E or Heat Pump Applications www.xonexsystems.com, (at least as early as Nov. 2, 2006), 2 pages.

"Owner's Manual", Aprilaire—Model 6504 www.aprilaire.com, (at least as early as Nov. 2, 2006.), pp. 1-12.

"Product Catalog", Arzel Zoning Technology, Inc. www.arzelzoning.com,(2006), pp. 1-8.

"Installation, Start-Up and Configuration Instructions", *Catalog No. 533-30011*, Carrier 3Vtm Control System/VVT Zone Controller/Pressure Dependent Control Part No. 33ZCVVTZC-01,(2004), pp. 1-14.

"DuroZone ED3 Zoning Panel", www.durodyne.com,(2004), 2 pages.

"Technical Bulletin", EWC Controls, Inc. TB-206—Model NCM 300 Zone Control System www.ewccontrols.com,(2000), pp. 1-12.

"EMM-3 Electronic MiniZone Panel", *68-3041-2 G.H. Rev. 10-02*, Honeywell, www.honeywell.com/yourhome, (Oct. 2002), pp. 1-12.

"EMM-3U Universal Electronic MiniZone Panel", *68-0237-2 G.H. Rev. 11-02*, Honeywell www.honeywell.com/yourhome, (Nov. 2002), pp. 1-16.

"TZ-4 TotalZone Zone Control Panel", *68-0259-1 G.H. Rev. 12-02*, Honeywell www.honeywell.com/yourhome, (Dec. 2002), pp. 1-20.

"Comfort System Z-600 Zone Control", Jackson Systems, LLC www.jacksonsystems.com,(at least as early as Dec. 29, 2006.), 4 pages.

"Lennox Harmony III Zoning System", (*83M77*) *HIII 5/05*, www.lennox.com,(2005), 4 pages.

"Homeowners Manual—Harmony III Zone Control System", Controls 505,024M /01/05, (Jan. 2005), pp. 1-6.

"SlimZone Premier Zone Control Panel", Robertshaw Climate Controls Americas www.icca.invensys.com, (2004),35 pages.

"Siemens 3-144", *CE1N3144en 13.02.2006*, KNX Synco 700 Universal Controllers RMUZ Building Technologies, HVAC Products Universal controllers RMU710, RMU720, RMU730, (Feb. 13, 2006), pp. 1-15.

"Electronic Controls—Zone Control Family", *Taco Catalog #100-5.0*, Taco Hydronic Components & Systems www.taco-hvac.com,(Sep. 1, 2003), 4 pages.

"Tracker—Tracker Version 12—Building Automation System", *BAS-PRC010-EN File No. PL-ES-BAS-000-PRC010-0503*, Trane www.trane.com, (May 2003), pp. 1-32.

"WR—CZ-4 Master Control Panel", www.white-rodgers.com, (at least as early as Dec. 29, 2006.), pp. 246-253.

"SmartZone System Manual", *P/N 220022-02*, CI Controls www.xcicontrols.com, (Oct. 3, 2005), pp. 1-20.

"Mini-Masterzone Zoning System—3 Zones", *Form 2233-060321*, Zonefirst MMZ3 Installation and Operating Instructions www.zonefirst.com,(2003), 4 pages.

http://www.appliancemagazine.com/printphp?article=1463 &zone=211&first=1, Appliance Magazine.com, "High-Efficiency HVAC Motor," 1 page, Jul. 2006.

http://www.ewccontrols.com/ultrazone/new_stuff.htm, "Newest Product, UZC4," 3 pages, Oct. 20, 2005.

http://www.geindustrial.com/cwc/products?pnlid=4&id=ecmph, GE Consumer and Industrial Electrical Distribution, ECM Product Information, 1 page, printed Feb. 28, 2007.

http://www.geindustrial.com/cwc/products?id=ecm&famid=23, GE Consumer and Industrial Electrical Distribution, GE ECM 2.3 Series Product Information, 2 pages, printed Feb. 28, 2007.

http://www.hvac-talk.com/vbb/printthread.php?t=99837&pp=40, "HVAC-Talk: Heating, Air & Refrigeration Disscussion," 5 pages, on or before Nov. 30, 2006.

http://www.hvac-talk.com/vbb/showthread.php?t=121627 &hightlight=zone+timer, "Multi Stage Control—Zone Board or Tstat," 2 pages, Nov. 17, 2006.

http://www.hvac-talk.com/vbb/showthread.php?t=75867 &highlight=DEHUM+zone+control, "Update on 4-Zone Arzel+Tappan Installation," 5 pages, May 2005.

http://www.jacksonsystems.com/index.php?module=z600, Jackson Systems, LLC, "Coming in March, Residential and Light Commercial Zone Control (Z-600) Two Position," 2 pages, at least as early as Feb. 8, 2007.

http://www.lennoxcommercial.com/support/faq.asp?a=a&category2&question=76, Lennox, "What is a Variable Speed Furnace?" 2 pages, 2007.

http://www.weinstall.ca/two_stage_heating.htm, "Clarkson Comfort Zone Two Stage Heating Variable Speed Furnace Systems," 2 pages, printed Jan. 26, 2007.

http://www.westinghousehvac.com/wh92_2stgvarspd.asp, Westinghouse Cooling and Heating, "92.1%* AFUE Two-Stage Variable Speed Gas Furnace," 2 pages, printed Jan. 26, 2007.

ABB, "To Measure is to Know, DIN Rail Mounted Electricity Meters," 12 pages, Jan. 2006.

ABB "Enclosures and Cable Systems Overview," 10 pages, Nov. 2002.

ABB Installation Material, 2 pages, prior to Nov. 30, 2006.

Bryant Heating & Cooling Systems, Model 340MAV, 350MAV, 355MAV, Condensing Gas Furnace, User's Information Manual, 2 pages, prior to Nov. 30, 2006.

Bryant, Thermidistat Control,TSTAT Installation and Start-Up Instructions, pp. 1-12, Aug. 1999.

Carrier, 58MVB 4-Way Multipoise Variable-Capacity Condensing Gas Furnace, Installation, Start-Up and Operating Instructions, 2 pages, Aug. 2005.

Drew, "Proper Staging Techniques for Multi-Stage Thermostats," XCI Corporation, 4 pages, Dec. 2002.

EWC Control Inc., Model UZC4 Zone Control Technical Bulletin, pp. 1-24, Dec. 12, 2005.

GE Industrial Systems, "Troubleshooting GE ECM Driven Systems," 2 pages, prior to Nov. 30, 2006.

GE ECM, "The X13 Blower Demo," pp. 1-13, 2006.

Lennox Industries Inc., G61 MPV Series Unit, Installation Instructions, 2 pages, Sep. 2006.

Lennox Industries Inc., Harmony III Zone Control System, Installation Instructions, 30 pages, Jan. 2006.

Robertshaw, "SlimZone Premier Zone Control System," Installation and Operation Manual, pp. 1-32, prior to Nov. 30, 2006.

Schneider Electric, "Square DQO Load Centers and Circuit Breakers, Unsurpassed Circuit Protection and Application Flexibility," 8 pages, 2004.

Square D, "QO Load Centers and Circuit Breakers, Unsurpassed Circuit Protection and Application Flexibility," 8 pages, 2004.

Variable Speed Motor Control Installation Instructions, pp. 1-29, Jul. 2006.

Zonefirst, "Masterzone Heat Pump Zoning System, Model MMH3," 2 pages, prior to Nov. 30, 2006.

* cited by examiner

HVAC STAGING CONTROL

FIELD OF THE INVENTION

The invention relates to the control of HVAC equipment, and more particularly, to the control of multi-stage HVAC equipment in a system having a plurality of zones.

BACKGROUND OF THE INVENTION

Many buildings, particularly relatively small buildings such as single-family houses, have a single heating, ventilation, and air conditioning (HVAC) unit that is controlled by a single thermostat. The HVAC unit typically comprises some type of fluid temperature conditioning device, such as a furnace for heating air, a boiler for heating a liquid or steam, or an air conditioner having an evaporating coil for cooling air. If the fluid is air, it is typically ducted to various locations within the building, or if it is liquid or steam, it is typically piped to heat exchangers at various locations in the building. The thermostat in this type of space conditioning system is typically positioned at a location where the heating and cooling loads are representative of the entire structure. For example, the thermostat may be installed in an interior room away from windows and doors that would tend to influence the sensed temperature. The HVAC equipment then controls the heating and cooling of the entire structure according to the thermostat signal received from the single location.

However, a single thermostat location may not accurately represent the heating or cooling needs throughout the structure. Other locations of the building may have significantly greater or lower heating and cooling loads than exist at the location of the thermostat. For example, rooms having a larger surface area of windows, or rooms having a greater area of exterior walls, may require greater heat inputs to maintain the desired temperature. Similarly, rooms facing south or west, or rooms that are on an upper story, may require greater cooling inputs to maintain the desired temperature. In cases where the HVAC equipment is controlled only by a single thermostat, the heating or cooling supplied to each individual area of the building will be based on the heating or cooling needs at the thermostat location and not on the actual heating and cooling needs of each individual area. As a consequence, the heating and cooling loads of individual areas of the structure may not be satisfied and the temperature of these areas will tend to deviate from the desired temperature.

In some situations, it may be desired to control different locations within a building at different temperatures. For example, rooms that are seldom occupied may not need to be maintained at the same temperature as rooms that are frequently occupied. Energy that is used to heat or cool these unoccupied rooms is not used effectively or economically. Also, rooms may be occupied by people having special temperature needs, such as an elderly person or an infant, that are preferably maintained at a different temperature than the rest of the building. However, a system that has only a single thermostat is generally unable to accurately control different locations in the building at different temperatures.

One solution to this problem is to utilize HVAC zone control. Rather than having a single thermostat controlling the HVAC equipment, multiple thermostats are positioned at locations within the building that are expected to have different heating and cooling loads. Although it is possible that each of these thermostats could control a separate fluid temperature conditioning device such as a separate furnace or air conditioner for each zone, that approach is generally neither efficient nor economical. Rather, most commonly the ductwork or piping that is used to transmit the conditioned fluid to the building spaces is configured with controls to adjust fluid flow to the various zones of the building corresponding to the various thermostats. For example, air ducts may be configured with controllable dampers that are capable of opening and closing to control the flow of air to a particular zone within the building when the thermostat in that zone calls for conditioning.

A system having HVAC zone control generally requires the use of a zone controller to receive the signals from the various thermostats, control the operation of the heating or cooling device, and control the distribution of the conditioned fluid through the ductwork. The zone controller typically comprises electronic circuitry for evaluating the heating or cooling needs of the various zones of the building and for determining an appropriate control of the heating or cooling device and the dampers or valves that control distribution. The distribution control where the conditioned fluid is air is typically accomplished with a duct damper. A duct damper typically comprises a variable obstruction within the duct that can be actuated to one position where there is relatively little resistance to air flow within the duct, and can be actuated to another position where there is relatively great, or complete, resistance to air flow. Duct dampers can be controlled by any of a number of actuation means, including electronic, pneumatic, or mechanical. The HVAC zone controller generally is configured to open or close a duct damper in order to effectuate control over a zone in response to thermostat signals.

In addition, some HVAC systems are equipped with a multiple stage fluid temperature conditioning device that has multiple heating or cooling output stages. For example, a furnace may be provided with multiple heat output stages such as where a variable flow gas valve or multiple burners are selectively controlled to provide a relatively lower heat output stage and a relatively higher heat output stage. Similarly, a multiple stage heat pump may be provided that has multiple compressor speeds where the different compressor speeds are controllable to vary the output rate of the device. In some other circumstances, multiple conditioning units are provided where the operation of a single device constitutes a relatively lower stage of output and operating multiple devices simultaneously constitutes a relatively higher stage of output. Oftentimes, heat pump systems are provided with secondary electrical resistance heating that can be engaged to provide higher stage heat output when necessary, particularly when the outdoor air temperature is low and the heat pump efficiency is low. Other types of multiple stage HVAC equipment exist.

In an HVAC system having both zone control and a multiple stage fluid temperature conditioning device, it can be challenging to determine the proper control strategy for the multiple stage fluid temperature conditioning device. There is a need for improved controls for multiple stage conditioning devices used in HVAC systems having zone control.

SUMMARY OF THE INVENTION

One aspect of the invention relates to a controller for controlling an HVAC system having a plurality of zones and having a multiple stage fluid temperature conditioning device. In one embodiment, the controller includes a plurality of thermostat terminals for receiving a plurality of thermostat signals from a plurality of thermostats, and where each thermostat is located within one of a plurality of zones, and where each one of the plurality of thermostat signals indicates a call for conditioning in the zone where that thermostat is located. The controller further includes a plurality of flow control terminals, where each flow control terminal is configured to transmit a signal to control one of a plurality of flow control devices in response to a call for conditioning in one of the plurality of zones. The controller also includes one or more timers that are connected to the thermostat terminals, where the one or more timers are configured to initiate a separate timing count upon each call for conditioning in any one of the plurality of zones. In addition, the controller includes one or more staging terminals for transmitting staging signals to control a multiple stage fluid temperature conditioning device, where the transmission of the staging signals determines whether the conditioning device will operate at a relatively higher output stage. The controller is also configured to make a timing count determination to determine if any one of the separate timing counts initiated upon each call for conditioning in any one of the plurality of zones exceeds a timing delay parameter. The transmission of staging signals depends on the timing count determination.

Another aspect of the invention relates to a method for controlling a multiple stage fluid temperature conditioning device of an HVAC system that has a plurality of zones. The method includes the step of receiving a plurality of thermostat signals from a plurality of thermostats, where each thermostat is located within one of a plurality of zones, and where each of the plurality of thermostat signals indicates a call for conditioning in the zone where that thermostat is located. The method further includes the steps of transmitting a flow control signal to one or more flow control devices in response to each thermostat signal calling for conditioning in one of the plurality of zones, storing a timing delay parameter, initiating a separate timing count upon the receipt of each thermostat signal, and making a timing count determination by determining whether any one of the separate timing counts exceed the timing delay parameter. The method further includes the steps of transmitting a staging signal to control the operation of the multiple stage fluid temperature conditioning device, wherein the transmission of the staging signal determines whether the conditioning device will operate at a relatively higher output stage. The transmission of the staging signal depends on the timing count determination.

The invention may be more completely understood by considering the detailed description of various embodiments of the invention that follows in connection with the accompanying drawings.

Figure 1:
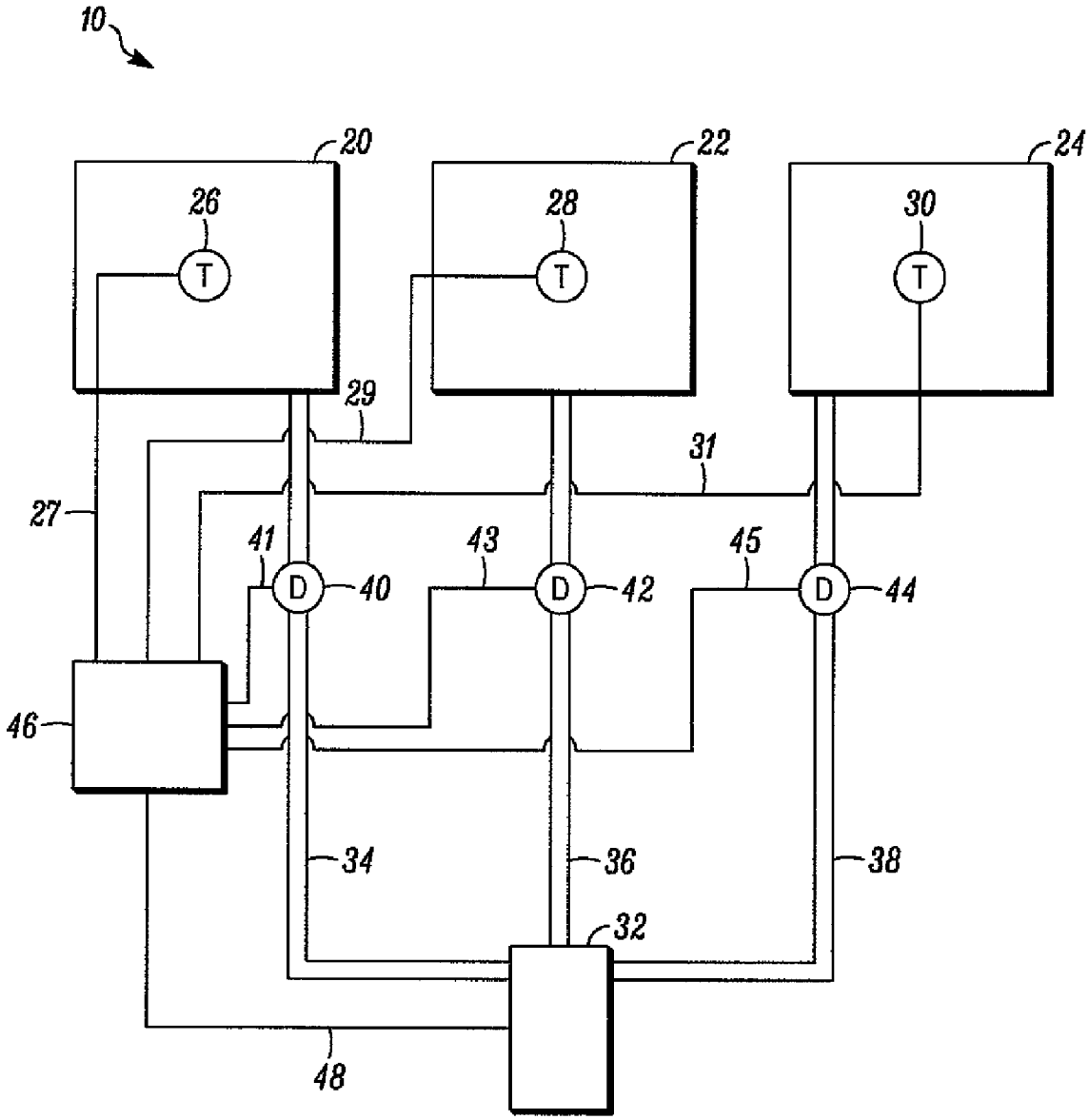
(PRIOR ART) FIG. 1
FIG. 1 is a schematic of an HVAC system having multiple zones (prior art).

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

As discussed above, it may be desirable for a building to have an HVAC system with zone control. FIG. 1 is a schematic of a typical HVAC system 10 having multiple zones. The embodiment of FIG. 1 is shown as having three zones. However, other embodiments having fewer or greater numbers of zones are usable. For example, some systems may have only two zones, while other systems may have four or more zones. Zones 20, 22, 24 are separate areas of a building. Each zone 20, 22, 24 includes a thermostat 26, 28, 30, respectively. A fluid temperature conditioning device 32, also called a conditioning device 32, is provided for increasing or decreasing the temperature of a fluid. For example, conditioning device 32 may be a furnace that increases the temperature of air. In the case where conditioning device 32 is a furnace, heated air is transmitted through ducts 34, 36, 38 to each of zones 20, 22, 24, respectively. Each duct 34, 36, 38 includes a damper 40, 42, 44, respectively, for controlling the flow of air through ducts 34, 36, 38. In other cases, conditioning device 32 may be a boiler, where hot water or steam is transmitted through pipes and controlled by valves. Zone controller 46 is configured to receive signals from each of thermostats 26, 28, 30, through cables 27, 29, 31, respectively. Zone controller 46 is also configured to transmit control signals to each of dampers 40, 42, 44, through cables 41, 43, 45. Zone controller 46 is further configured to transmit control signals to conditioning unit 32 through cable 48.

A variety of control strategies for zone controller 46 are usable. In general, however, zone controller 46 is configured to open and close dampers 40, 42, 44, in response to signals from thermostats 26, 28, 30, respectively, and to operate conditioning device 32. For example, if zone controller 46 senses that thermostat 26 is calling for heat because the temperature in zone 20 has fallen below a preset level, then zone controller 46 sends a signal to conditioning device 32 to turn on and signals damper 40 to be in an open position. Heated air from conditioning device 32 will then travel through duct 34, through damper 40, and into zone 20, thereby tending to increase the temperature within zone 20. If at the same time thermostats 28, 30 in zones 22, 24 do not call for heat, dampers 42, 44 will be in a closed position and heated air will not travel through ducts 36, 38 into zones 22, 24. The operation of HVAC system 10 in response to other thermostat signals from other zones and other combinations of zones is similar. HVAC system 10 may include other sensing devices and other sources of input to zone controller 46, as well as other actuating devices and other devices that are controlled by zone controller 46.

In an HVAC system having both zone control and a multiple stage fluid temperature conditioning device, it can be challenging to determine the proper control strategy for the multiple stage fluid temperature conditioning device. For example, it is generally desired that the second or relatively higher stages of output of the temperature conditioning device be utilized only when necessary. In some cases, such as where resistance heating is provided to supplement a heat pump, the second or higher stages of output may be more expensive to operate and therefore should be used only when absolutely needed. Furthermore, it is desired that the multiple stage equipment be controlled in a manner that causes the amount of time the equipment runs in response to calls for conditioning from the thermostats to be optimized. This is desirable because run times that are very short, such as where the equipment is operating in too high of a stage, can cause frequent cycling of the multiple stage conditioning device and consequent low efficiency and high wear, and can also cause the temperature in the space to overshoot the set point. Likewise, run times that are very long, such as where the equipment is operating in too low of a stage, can cause excessive noise, deviation from set temperature for an excessive period of time, and also high equipment wear.

Figure 2:
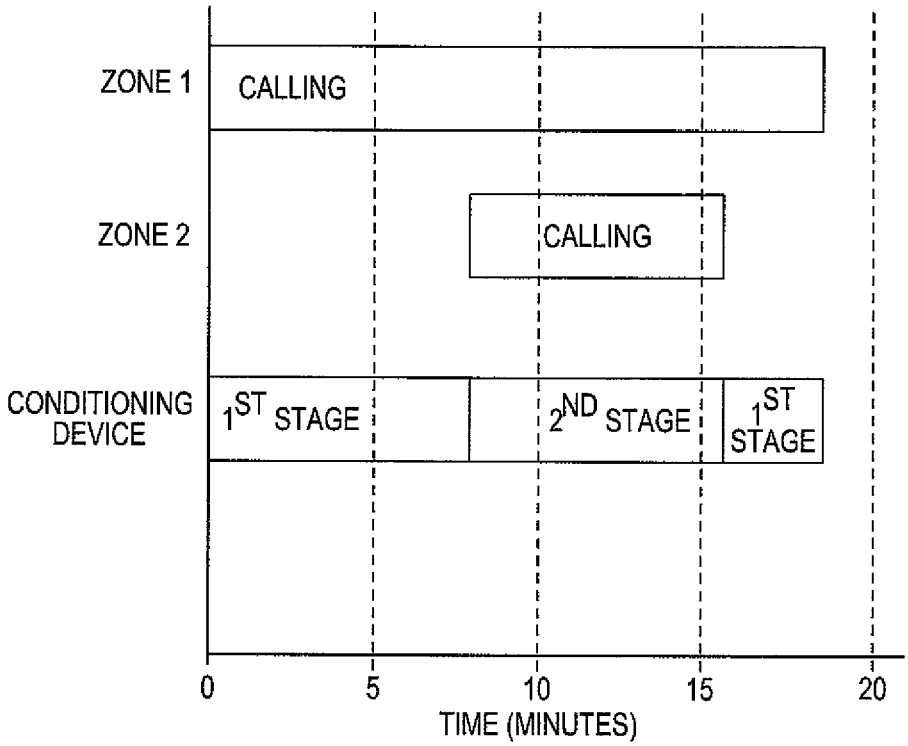
(PRIOR ART) FIG. 2
FIG. 2 is a schematic of an operating characteristic of a prior art system.
Figure 3:
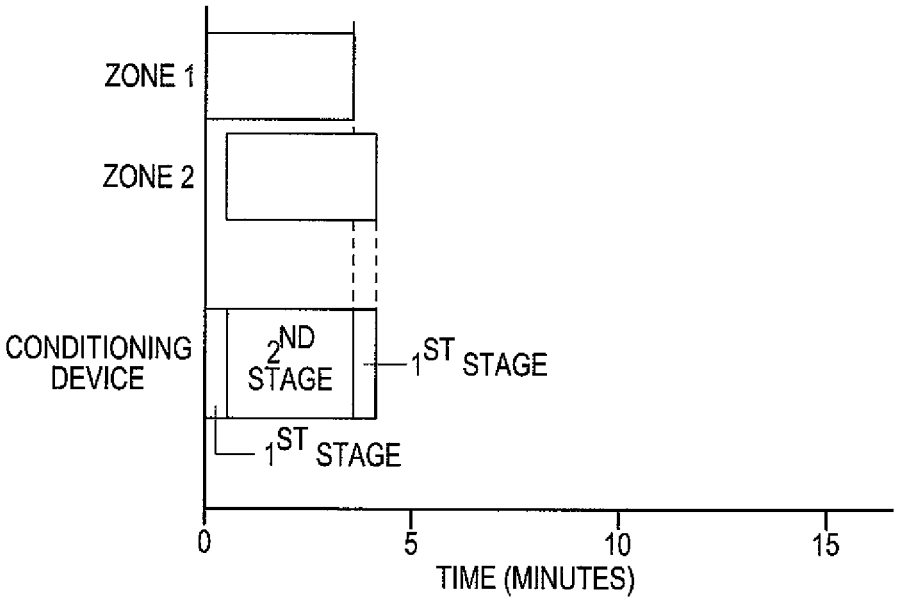
(PRIOR ART) FIG. 3
FIG. 3 is a schematic of an operating characteristic of another prior art system.

Various strategies exist for controlling a multiple stage fluid temperature conditioning device in a zone control system. For example, some zone controllers use the number of zones that are calling for conditioning to determine whether to up-stage or down-stage the conditioning device. An example of an operating characteristic of this type of system is shown in FIG. 2. In the embodiment depicted, the zone controller is configured to operate the conditioning device in a lower stage (labeled "$1^{st}$ Stage") where only a single zone is calling, and to operate the conditioning device in a higher stage (labeled "$2^{nd}$ Stage") where more than one zone is calling for conditioning. However, this strategy may fail to address the situation where multiple zones call for conditioning simultaneously, but where the demands can be satisfied relatively quickly, such as is depicted in FIG. 3. In this case, the conditioning device may be unnecessarily operated at a higher stage and high equipment cycling may result.

Figure 4:
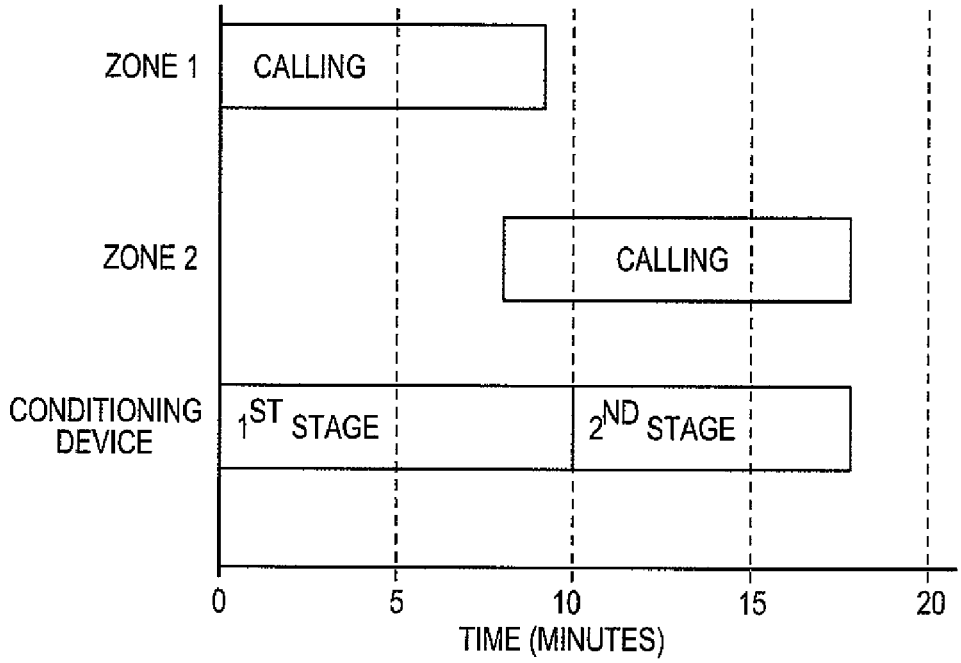
(PRIOR ART) FIG. 4
FIG. 4 is a schematic of an operating characteristic of another prior art system.

Some other zone controllers utilize a timer to control the up-staging and down-staging of the conditioning device, such that if the conditioning device has been running for a set period, such as 10 minutes, the conditioning device is up-staged to a relatively higher output. However, this strategy may fail to account for the situation where multiple zones call for conditioning in a generally sequential fashion, such that each zone may be satisfied relatively quickly but where the combination of sequential zones calling for conditioning causes the equipment to run for a relatively long period of time. This relatively long run time may cause the equipment to upstage inappropriately, such as shown in FIG. 4.

Figure 5:
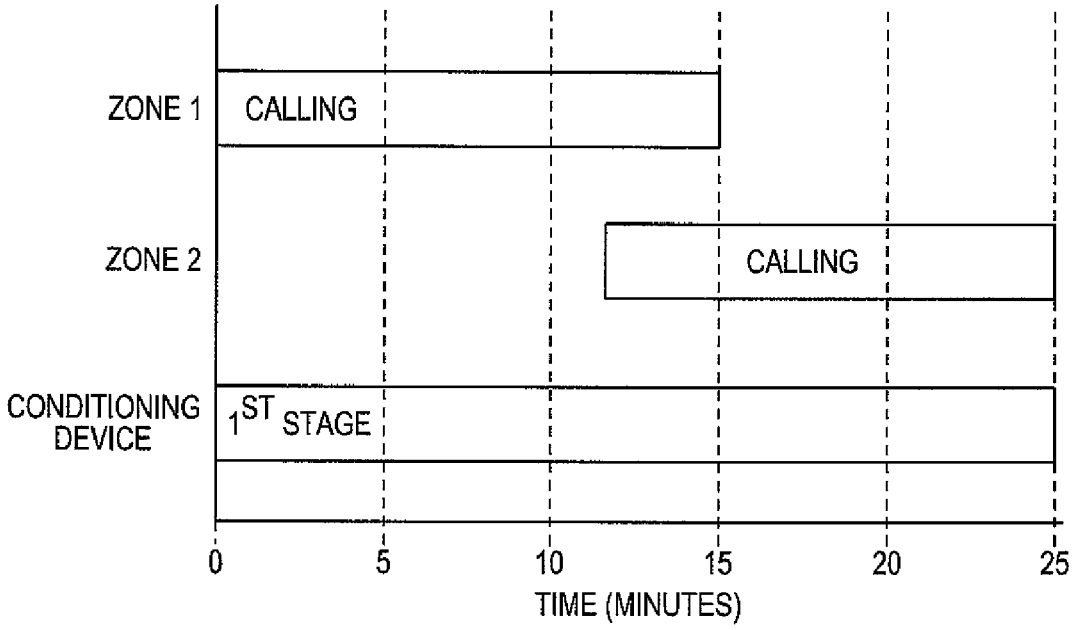
(PRIOR ART) FIG. 5
FIG. 5 is a schematic of an operating characteristic of another prior art system

Still other zone controllers attempt to resolve these problems with a combination of strategies. For example, some zone controllers may utilize a timer to control up-staging, where the timer is only utilized if a certain number or percentage of zones are calling for conditioning. By way of example, the timer in this type of zone controller could be configured to be initiated when two zones are calling for conditioning, and in this way would up-stage the equipment only after satisfying both the required time delay and number of zones calling. This system, however, would fail to properly up-stage the equipment when only a single zone is calling for an extended period of time or where the zones call sequentially with minimal overlap, such as is shown in FIG. 5. This may result in excessively long equipment run times and a deviation in the zone from the set point temperature.

Still other strategies exist for controlling a multi-stage fluid temperature conditioning device in a zoned HVAC system. For example, some systems may rely on a signal sent from a thermostat that represents the difference between the set point and the measured temperature. The system is then configured to initiate a higher stage of operation when the temperature difference exceeds a threshold. However, this system may fail to account for the situation where the conditioning device runs for a long period of time without satisfying the call for conditioning, but where the difference in temperature is not great enough to enable operation at a higher stage.

Figure 6:
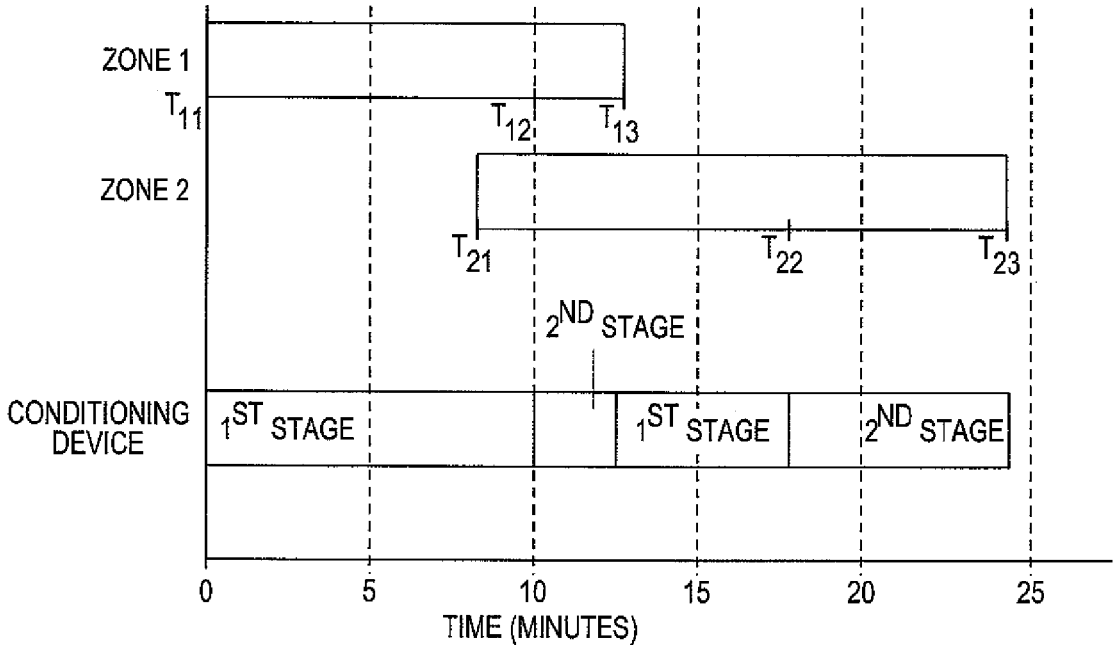
FIG. 6 is a schematic of an operating characteristic of an HVAC system having a zone controller constructed according to the principles of the present invention.

The present invention addresses various shortcomings of current systems. An operating characteristic of a zone controller constructed according to the principles of the present invention is depicted in FIG. 6. The zone controller of the present invention is constructed to include a timer for each zone. Each timer is configured to begin a timing count when the respective zone initiates a call for conditioning. The zone controller further includes a set or programmed up-staging delay parameter that controls the amount of time that the conditioning device runs in a lower stage before being up-staged to a higher output stage. The up-staging delay parameter is configured such that when the timer count equals or exceeds the up-staging delay parameter, then the conditioning device is signaled to operate at a higher output stage. This up-staging delay may be the same for each zone or may be configured to be individualized for each zone. Furthermore, where the conditioning device has more than two stages, there may be separate up-staging delay parameters for each stage of the device. The zone controller control strategy is therefore configured to up-stage the equipment based on the individual zone timer having the greatest demand. In other words, if any zone timer is calling for up-staging, then the equipment will be upstaged until no zone timer is calling for up-staging.

Some embodiments further include a time buffer to prevent overly frequent staging changes. In these embodiments, the zone controller includes a set or programmed stage time buffer parameter that controls the minimum amount of time between staging changes. The zone controller is then configured to control the staging of the conditioning device based both on the individual zone timers as well as the time buffer. The time buffer is generally configured to override staging changes that would otherwise be commanded based only on the zone staging timers. The time buffer measures the amount of time since the last staging change and prevents staging changes until a certain amount of time has passed.

Some embodiments of a zone controller constructed according to the principles of the present invention also include inputs from one or more sensors, where these inputs are used as factors affecting the control of the stage of the conditioning device. For example, in one embodiment, a discharge air temperature sensor is provided that generates a signal representative of the temperature of the air leaving the conditioning device. The zone control is then configured to have a set or programmed value for a discharge air temperature limit. This is most commonly used in a furnace or heating device, where the discharge air temperature limit is used to prevent the furnace from up-staging when the discharge air temperature is above a certain temperature. This prevents possible damage to the furnace or associated equipment from operating at too high of a temperature.

An operating characteristic of a zone controller constructed according to the present invention is depicted in FIG. 6. The embodiment of FIG. 6 depicts a two-zone system; however, the operating principles are readily adaptable to zoned systems having a greater number of zones. Each zone is configured to have a timer that initiates a timing count at the beginning of a call for conditioning. In the example embodiment of FIG. 6, each timer is configured with a 10 minute delay parameter, such that when any zone has been calling for conditioning for 10 or more minutes, then a signal is generated to cause the conditioning device to up-stage to a higher output stage. For ease of description here, the function of a time buffer or other sensor input, if present in the system, is ignored. The up-staging occurs when the timer count of any timer has exceeded its set delay parameter. As seen in FIG. 6, the timer associated with Zone 1 initiates a timer count at time $T_{11}=0$. At time $T_{12}=10$ minutes, the Zone 1 timer has satisfied the delay parameter and there is still a call for conditioning in Zone 1. Therefore, the zone controller initiates a signal that causes the conditioning equipment to up-stage to a second stage at time $T_{12}$.

At time $T_{21}$=8 minutes, Zone 2 initiates a call for conditioning, and consequently the timer associated with Zone 2 initiates a timer count. Thereafter, at time $T_{13}$=13 minutes, Zone 1 terminates a call for conditioning while Zone 2 maintains a call for conditioning. Because Zone 1 is no longer calling for conditioning, and because Zone 2 has not yet satisfied its delay parameter, the highest stage being commanded is a first (or relatively lower output) stage. The conditioning device is down-staged to stage 1 at time $T_{13}$. Zone 2 continues its call for conditioning, until at time $T_{22}$=18 minutes, zone 2 has satisfied its delay parameter of 10 minutes. Therefore, Zone 2 initiates a request for a higher stage of operation and the conditioning device is operated at a second (or higher) stage. This continues until time $T_{23}$=25 minutes when Zone 2 terminates a call for conditioning. At this point, there is no remaining call for conditioning and the conditioning device is turned off.

Figure 7:
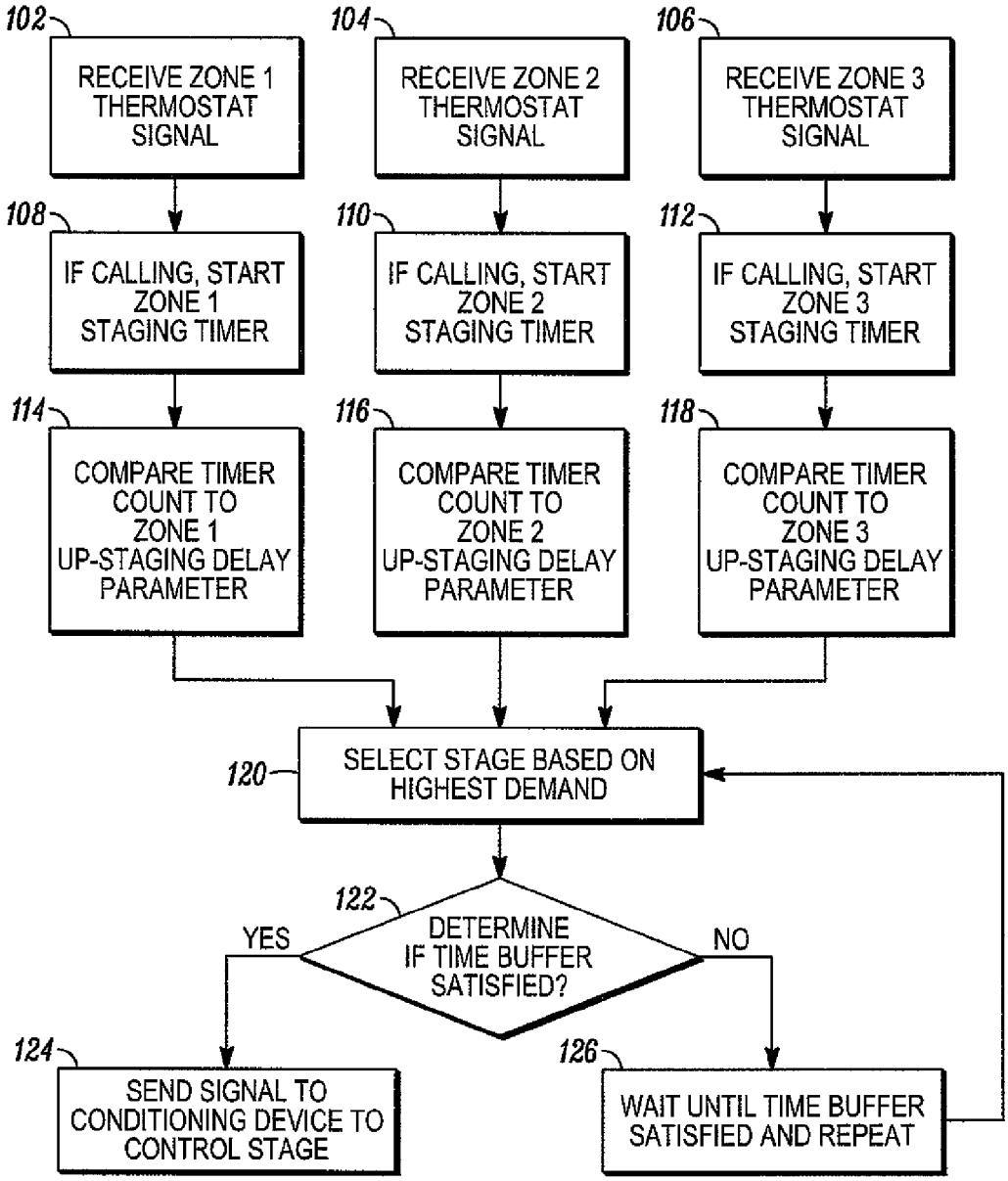
FIG. 7 is a flow chart of the operation of an embodiment of a zone controller constructed according to the principles of the present invention.

An exemplary flow chart of the operation of a zone controller constructed according to the principles of the present invention is depicted in FIG. 7. The embodiment of FIG. 7 is shown as having three zones, although fewer or greater numbers of zones are also usable, and is also shown as having a time buffer. In steps 102, 104, 106, the zone controller receives signals from the thermostats in zones 1, 2, and 3, respectively. At steps 108, 110, and 112, the zone controller utilizes a staging timer for each zone to initiate a staging time count when the respective thermostat begins a call for conditioning. Each staging timer produces an output that represents the amount of time that that particular zone has been calling for conditioning. Each of these staging timer outputs is then compared against an up-staging delay parameter at steps 114, 116, 118. There may be multiple up-staging delay parameters used for each zone if the conditioning device is capable of more than two stages of operation. For example, the up-staging delay parameter may be configured to upstage to a second stage when a zone has been calling for conditioning for 10 minutes, and to upstage to a third stage when a zone has been calling for conditioning for 15 minutes.

Steps 114, 116, 118 each produce an output that represents the stage called for by each zone. At step 120, the output of steps 114, 116, and 118 is received and evaluated to determine the highest stage demanded. Prior to commanding the conditioning device to operate at a different stage, the time buffer is consulted at step 122. The time buffer tracks the amount of time since the last staging change. The time buffer includes a time buffer parameter that must be satisfied in order for the zone controller to change the stage. For example, if the zone 1 staging timer calls for up-staging to a second stage, while zone 2 is also calling for conditioning but at a lower stage, and then after a relatively short period of time zone 1 stops calling for conditioning, the conditioning device will continue to operate at the higher stage until the time buffer parameter has been satisfied. This prevents the conditioning device from undergoing rapid staging changes. Therefore, if the time buffer has been satisfied, such that there has not been a staging change within a set period of time, then at step 124 a signal is sent to the conditioning device to control the stage. However, if the time buffer has not been satisfied, such that there has been a staging change within the set time period, then step 126 involves repeating steps 120 and 122 until the time buffer is satisfied or the request for a different stage changes.

Figure 8:
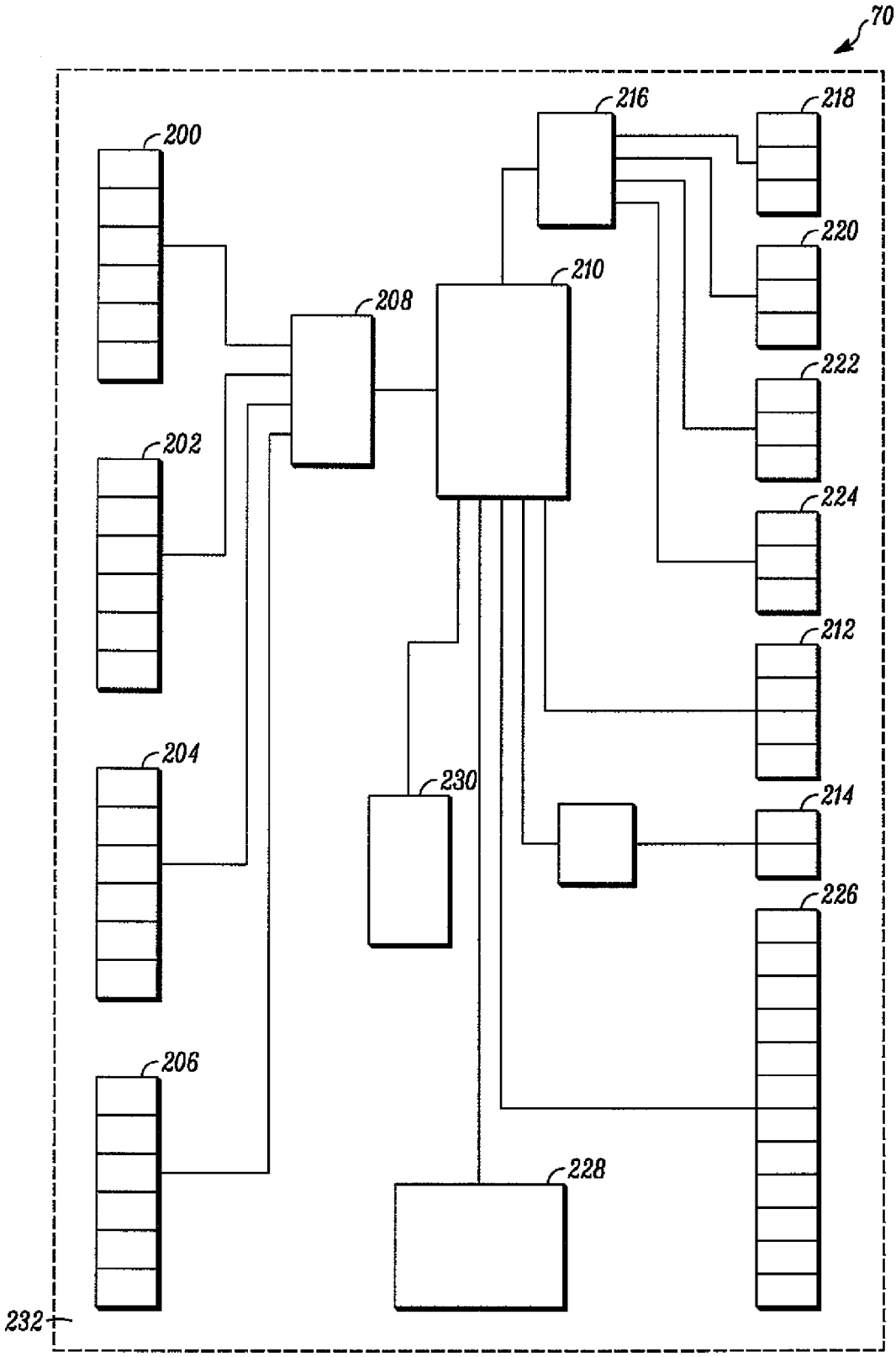
FIG. 8 is a schematic representation of the electronic components of an embodiment of a zone controller.

FIG. 8 schematically depicts an embodiment of electronic components of a zone controller 70 constructed according to the principles of the present invention. However, many other embodiments and configurations of zone controller 70 are usable with the present invention. The zone controller 70 of FIG. 8 is configured for use with four zones. However, other configurations for other numbers of zones are usable. Zone controller 70 of FIG. 8 includes four thermostat terminals 200, 202, 204, 206. Each thermostat terminal 200, 202, 204, 206 is configured to receive wires from a thermostat. The number of wires depends on the thermostat and HVAC equipment that the zone controller is intended to be used with. The operation and characteristics of thermostats are known to those of skill in the art. The thermostat terminals 200, 202, 204, 206 are configured to receive each of the thermostat wires that are present. The installer brings the wires from each thermostat to the zoning panel and connects each wire to the corresponding connection terminal.

Signals received at thermostat terminals 200, 202, 204, 206 are transmitted to an input processing component 208 and further to a microprocessor 210. Microprocessor 210 is configured to receive signals from sensor terminal 212. Sensor terminal 212 may be configured to receive signals from sensors such as an outdoor air temperature sensor and a discharge air temperature sensor. Other sensors are usable. The nature and construction of these sensors are known to those of skill in the art. A power input 214 is provided for connection to a power supply transformer. Microprocessor 210 is further configured to transmit signals to a driver 216, which in turn transmits signals to a plurality of damper terminals 218, 220, 222, 224. Each of damper terminals 218, 220, 222, 224 is configured to receive wires that are used to transmit a signal to a damper to control the position of the damper. Microprocessor 210 is also configured to transmit signals to an equipment terminal 226. Equipment terminal 226 is configured to receive wires that are used to transmit signals to HVAC conditioning device, such as a furnace, boiler, air conditioner, or heat pump, to control the operation of the HVAC equipment. In one embodiment, one or more of equipment terminals are staging terminals that control the stage of operation of the HVAC equipment. An interface 228 may also be provided that is in communication with microprocessor 210 and is used to input various parameters and make various selections to affect the operation of the zone controller 70. Interface 228 may take a number of forms, such as a plurality of dip switches, dials, and potentiometers and other electronic components, an LCD screen and buttons, or a plurality of film-style switches. Interface 228 is particularly adapted for use during the installation process in order to configure the zone controller 70 to operate properly with the specific HVAC equipment that is present. Operation module 230 is intended for use during the operation of the zone controller 70 for determining the status of the zone controller 70 and for providing operation inputs. For example, operation module 230 may be configured to provide indicator lights that indicate the status of an aspect of zone controller 70, and may be configured to provide switches for setting a mode of operation. Operation module 230 is in communication with microprocessor 210. Each of the electrical components of zone controller 70 is attached to an electronic board 232.

In operation, signals received at thermostat terminals 200, 202, 204, 206 are transmitted to microprocessor 210. When a thermostat signal is received at microprocessor 210 that represents a call for conditioning in a particular zone, a timer count is initiated in microprocessor 210 that represents the amount of time the zone has been calling for conditioning. Microprocessor 210 includes one or more timers that are configured to initiate a separate timing count upon each call for conditioning in a zone. Microprocessor 210 may also include memory that stores one or more staging delay parameters, as well as other parameters such as a time buffer parameter and a discharge air temperature limit. At the time that a call for conditioning is received, the microprocessor 210 initiates a signal to one of corresponding damper terminals 218, 220, 222, 224 to cause the appropriate dampers to be open. Microprocessor 210 also initiates a signal to equipment terminal 226 to instruct the conditioning device to begin operating. Microprocessor 210 generally performs the operations depicted in FIG. 7, such that at appropriate times the microprocessor 210 causes a signal to be transmitted to the conditioning device to cause it to operate at a higher stage, until such time as the conditioning device is commanded to operate at a lower stage or to turn off.

Other embodiments of a zone controller are usable. For example, instead of the one or more zone timers being part of a microprocessor, the one or more timers may be separate circuits or components configured to generate a timing count corresponding to the amount of time that a particular zone has been calling for conditioning.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. A controller configured to control an HVAC system having a plurality of zones and having a multiple stage fluid temperature conditioning device, the controller comprising:

(i) a plurality of thermostat terminals for receiving a plurality of thermostat signals from a plurality of thermostats, each thermostat located within one of a plurality of zones, where each one of the plurality of thermostat signals indicates a call for conditioning in the zone where that thermostat is located;

(ii) a plurality of flow control terminals, each flow control terminal configured to transmit a signal to control one of a plurality of flow control devices in response to a call for conditioning in one of the plurality of zones;

(iii) one or more timers connected to the thermostat terminals, the one or more timers configured to initiate a separate timing count upon each call for conditioning in any one of the plurality of zones; and (iv) one or more staging terminals for transmitting staging signals to control a multiple stage fluid temperature conditioning device, wherein the transmission of the staging signals determines whether the conditioning device will operate at a lower output stage or a higher output stage;

(v) wherein the controller is configured to make a timing count determination to determine if any one of the separate timing counts initiated upon each call for conditioning in any one of the plurality of zones exceeds a timing delay parameter;

(vi) wherein the transmission of staging signals depends on the timing count determination.

2. The controller of claim 1, wherein if the timing count determination is positive, then a staging signal is transmitted to control the conditioning device to switch from operating at the lower output stage to operating at the higher output stage.

3. The controller of claim 1, where the conditioning device is controlled at the lower output stage when none of the separate timing counts exceed the timing delay parameter.

4. The controller of claim 1, wherein each zone is assigned a corresponding timing delay parameter, wherein the controller is configured to make the timing count determination for each zone to determine if any one of the separate timing counts exceeds the corresponding timing delay parameter.

5. The controller of claim 1, further comprising a first timing delay parameter and a second timing delay parameter, wherein where the conditioning device is controlled at an intermediate output stage while one of the timing counts associated with a call for conditioning exceeds the first timing delay parameter, and where the conditioning device is controlled at the higher output stage while a timing count associated with a call for conditioning exceeds the second timing delay parameter.

6. The controller of claim 1, wherein a particular one of the separate timing counts is terminated when the call for conditioning that initiated the particular separate timing count is terminated.

7. The controller of claim 1, where the conditioning device is further controlled by a stage change time buffer that prevents a change in the output stage of the conditioning device within a predetermined period of time from a previous change in output stage.

8. The controller of claim 1, where the conditioning device is further controlled in response to a discharge air temperature sensor that prevents the conditioning device from operating at the higher output stage if the discharge air temperature is beyond a limit.

9. The controller of claim 1, further comprising a microprocessor, where one or more timers are incorporated in the microprocessor.

10. The controller of claim 9, where the microprocessor further includes memory, and where the memory is configured to store the timing delay parameter.

11. A method of controlling a multiple stage fluid temperature conditioning device of an HVAC system having a plurality of zones, the method comprising:

(i) receiving a plurality of thermostat signals from a plurality of thermostats, each thermostat located within one of a plurality of zones, where each of the plurality of thermostat signals indicates a call for conditioning in the zone where that thermostat is located;

(ii) transmitting a flow control signal to one or more flow control devices in response to each thermostat signal calling for conditioning in one of the plurality of zones; and (iii) storing a timing delay parameter;

(iv) initiating a separate timing count upon the receipt of each thermostat signal;

(v) making a timing count determination by determining whether any one of the separate timing counts exceed the timing delay parameter;

(iv) transmitting a staging signal to control the operation of the multiple stage fluid temperature conditioning device, wherein the transmission of the staging signal determines whether the conditioning device will operate at a lower output stage or a higher output stage, wherein the transmission of the staging signal depends on the timing count determination.

12. The method of claim 11, wherein if the timing count determination is positive, then a staging signal is transmitted to control the conditioning device to operate at the higher output stage.

13. The method of claim 11, where the conditioning device is controlled at the lower output stage when none of the separate timing counts exceed the timing delay parameter.

14. The method of claim 11, where the step of storing a timing delay parameter comprises assigning a timing delay parameter to each zone, where the step of making a timing count determination comprises determining whether any of the separate timing counts exceed the timing delay parameter for the zone corresponding to the separate timing count.

15. The method of claim 11, where the step of storing a timing delay parameter comprises storing a first timing delay parameter and a second timing delay parameter, and where the conditioning device is controlled at an intermediate output stage while a timing count associated with a call for conditioning exceeds the first timing delay parameter, and where the conditioning device is controlled at the higher output stage while a timing count associated with a call for conditioning exceeds the second timing delay parameter.

16. The method of claim 11, where the step of transmitting a staging signal to control the conditioning device further includes controlling the conditioning device by a stage change time buffer that prevents a change in the output stage of the conditioning device within a period of time from a previous change in output stage.

17. The method of claim 11, where the step of transmitting the staging signal to control the conditioning device further includes controlling the conditioning device in response to a discharge air temperature sensor that prevents the conditioning device from operating at the higher output stage if the discharge air temperature is above a limit.

* * * * *